US005190387A

United States Patent [19]

Auth

[11] Patent Number: 5,190,387

[45] Date of Patent: Mar. 2, 1993

[54] KEYBOARD ACCOUTERMENT TRAY

[76] Inventor: Marc A. Auth, 549 Ridgeway Dr., Twin Falls, Id. 83301

[21] Appl. No.: 851,079

[22] Filed: Mar. 13, 1992

[51] Int. Cl.[5] ..... B41J 29/00

[52] U.S. Cl. ..... 400/717; 400/679

[58] Field of Search ..... 400/717, 718, 679, 713, 400/714, 715, 716, 719; 248/639, 918, 231.4, 231.7, 279; 38/106, 107, 141, 142

[56] References Cited

U.S. PATENT DOCUMENTS

| | | | |
|---|---|---|---|
| 3,065,344 | 11/1962 | Chervenka | 108/28 |
| 3,080,141 | 3/1963 | Ricci | 38/107 |
| 4,154,010 | 5/1979 | Evans | 38/106 |
| 4,890,561 | 1/1990 | Hampshire et al. | 108/143 |

FOREIGN PATENT DOCUMENTS

| | | | |
|---|---|---|---|
| 0322638 | 7/1989 | European Pat. Off. | 38/142 |
| 0894909 | 1/1945 | France | 400/717 |

*Primary Examiner*—Edgar S. Burr
*Assistant Examiner*—Anthony H. Nguyen

[57] ABSTRACT

The invention is an accouterment tray which clamps securely to the edge of a keyboard to make a combined rigid and portable unit. The tray has a flat tray-wing portion connected to a support portion which extends under the keyboard. A clamp, connected to the support portion, securely attaches the tray to the keyboard. Optionally, the tray has vertical retaining walls, and two J-shaped clamps which make the clamping system adaptable to most keyboards.

11 Claims, 7 Drawing Sheets

KEYBOARD ACCOUTERMENT TRAY

BACKGROUND OF THE INVENTION

1. Technical Field

This invention relates to computers and computer keyboards. This invention is a tray to be attached to a keyboard for supporting computer accessories, for example, a "mouse" input device or other work station accouterments, in such a way that the keyboard and the accessories or accouterments may be conveniently used a distance away from the computer table or in the user's lap.

2. Background Art

A constantly growing number of computer users employ a pointing device, such as a mouse, as an aide in quickly navigating through various software applications. The mouse saves key strokes needed to move around the monitor screen in such software packages as, for example, the popular "Windows" Graphical User Interface. A mouse is best employed when it rests on a firm, flat surface close to the keyboard so that the user can operate it efficiently with one hand and move easily back and forth between the mouse and keyboard.

Many computer users prefer a work position that involves sitting back in a comfortable chair, at some distance from the computer table or desk, and holding the keyboard in the user's lap. Some computer users, due to a disability, for example, require a work position at some distance from the computer. In this position, operating a mouse in addition to the keyboard becomes a particular problem. The operation becomes inconvenient, uncomfortable, and inefficient.

The traditional resting place for a mouse or other input device is a table or desk top beside a keyboard. Alternatively, U.S. Pat. No. 4,913,387 (Tice) teaches that a sliding bar may be mounted to the table or cart underneath the keyboard, so that the bar extends past the end of the keyboard and acts as a mounting support on which an input device may be hooked or fastened. U.S. Pat. No. 4,949,080 (Mikan) teaches a keyboard enclosure to which an input device, in this case a joystick, is permanently mounted. U.S. Pat. No. 5,074,511 (Wilson) teaches a large platform, the rear portion of which is placed under and held down by the weight of a computer CPU or monitor, and the front portion of which extends out from a table as an extension for holding a keyboard and other accessories.

None of these prior approaches provides a device supported by the keyboard that securely but removably supports an accouterment next to the keyboard for convenient and comfortable use in the user's lap or away from the computer. None of these prior approaches provides a device that can be easily adjusted to fit virtually any keyboard. None of these prior approaches provides a device that serves both right-handed and left-handed computer users.

DISCLOSURE OF INVENTION

This invention is a tray attached to a keyboard for holding accouterments, such as a "mouse" or other input device, in close proximity to the keyboard so that both keyboard and mouse may be conveniently employed on a user's lap while a distance away from the computer table or desk. The accouterment tray is simple and lightweight, easily attached to and removed from the keyboard, and easily switched between right-handed and left-handed use. The design of the preferred embodiment allows the accouterment tray to fit virtually all brands, styles, and models of keyboards used with IBM and IBM-compatible computer systems. Also, the dimensions of the preferred embodiment provide the industry-standard "mousepad" for a mouse input device.

The invention includes a tray-wing portion which has a firm and flat upper planar surface for supporting accouterments. The tray-wing may include an optional vertical wall along the outer perimeter edge of the planar surface on all sides except the side from which extends a support member. The vertical wall acts as a rail to prevent the mouse or other accouterment from sliding off the tray. The upper planar surface of the tray-wing may also be sized to match the dimensions of a standard mousepad, which many users employ when using a mouse, to hold the mousepad more securely and to further aid in preventing the mousepad from falling off the tray.

A support member extends integrally from the tray-wing and has an upper planar surface for being placed beneath the bottom surface of a keyboard, said keyboard having a top surface supporting the keyboard keys, side edges and a bottom side opposite the top surface. A clamp is attached to the support member to secure the support member to the keyboard. The keyboard and attached accouterment tray form a rigid structure that may be easily placed on the user's lap while operating either the keyboard or the mouse alone or while operating the keyboard and the mouse together at the same time.

The clamp may include two adjustable brackets which are movably attached to the support member and extend from the support member to grasp opposing edges of a keyboard. These brackets slide in or out to various degrees of extension and can be locked in any extended position.

BEST MODE FOR CARRYING OUT INVENTION

Figure 1:
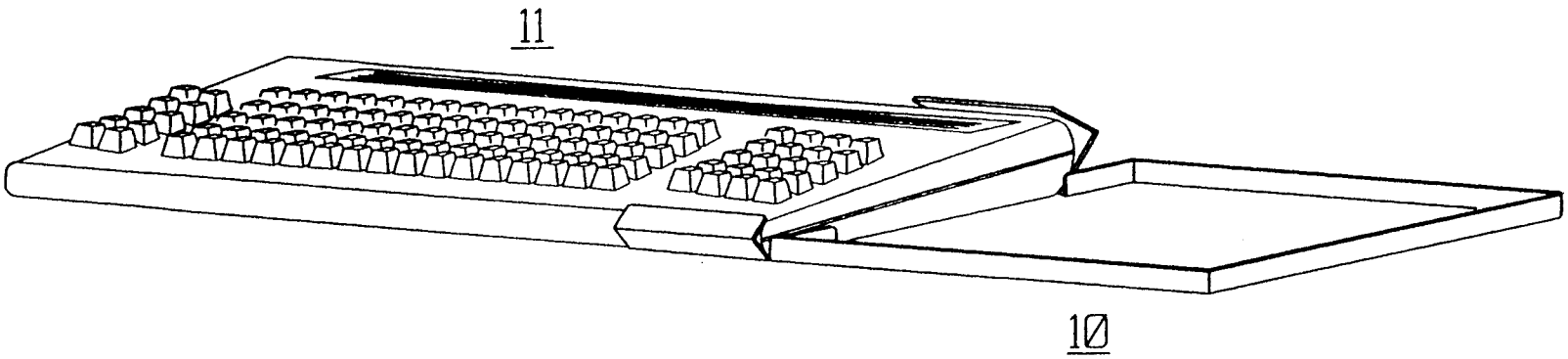
FIG. 1 is an isometric view of one embodiment of my accouterment tray attached to a keyboard.

The best mode or "preferred embodiment" of the keyboard accouterment tray is shown generally at 10 attached to a keyboard 11 in FIG. 1. The tray-wing 12 has a flat, firm, upper planar surface 13. Fully on three sides, and partially on one side of the tray-wing 12, walls 14 may be integrally attached to the outer perimeter edge at approximately 90 degrees to the planar surface 13. These walls 14 act as a vertical rail to aid in preventing a mousepad, input device, accessory or accouterment from sliding or falling off of the tray-wing 12. The walls 14 are about 0.5 inches high, so that they extend about 0.25 inches above a standard mousepad, which is typically 0.25 inches high. In the preferred embodiment, the planar surface 13 may be a rectangle 8.125 inches wide by 9.625 inches long, measured inside the walls 14 from the perspective of a person using the keyboard and tray. These dimensions accommodate the outer measurements of a standard mousepad and result in the mousepad or other suitable material being held more snugly and securely on the tray-wing 12.

Figure 4A:
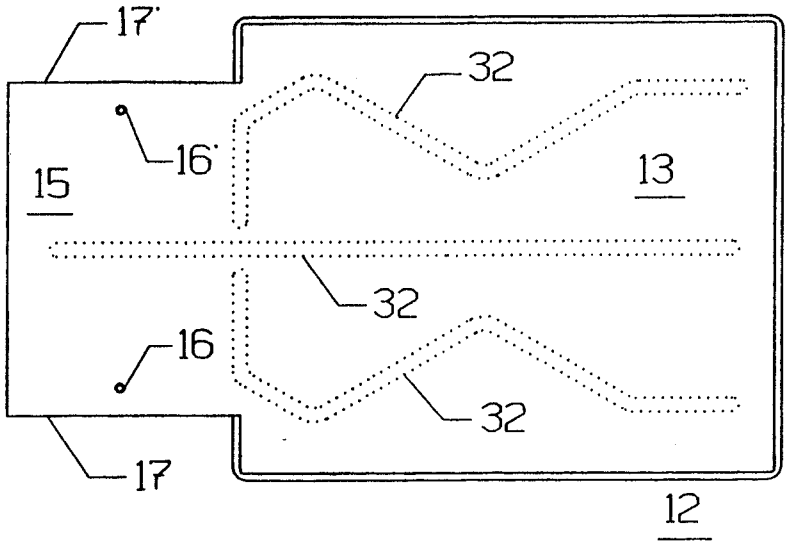
FIGS. 4*a, b* and *c* are top, front and right side views, respectively, of one embodiment of my accouterment tray without clamps.
Figure 4B:
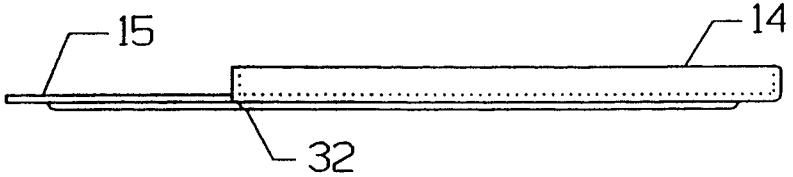
Figure 4C:
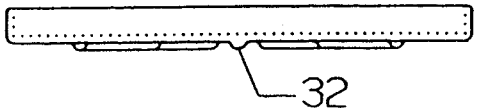

A support member 15 extends from, and is integrally and rigidly joined to, a side of the tray-wing 12 without an optional wall 14. Shown in FIG. 4, the support member 15 is a planar tongue about 6 inches wide, as measured from its front edge to its back edge, extending out about 4 inches in length from the tray wing 12. Holes 16 and 16' are placed approximately 0.5 inch from the front edge 17 and back edge 17' of the support member 15.

Figure 5A:
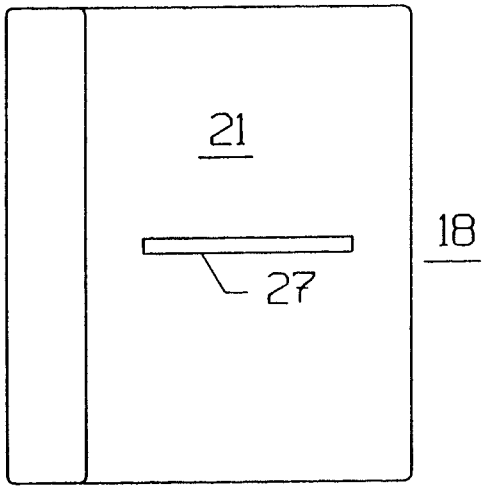
FIGS. 5*a, b* and *c* are top, side and front views, respectively, of a smaller clamp according to my invention.
Figure 5B:
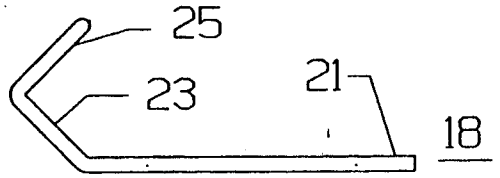
Figure 5C:
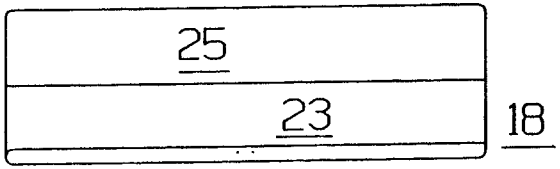
Figure 6A:
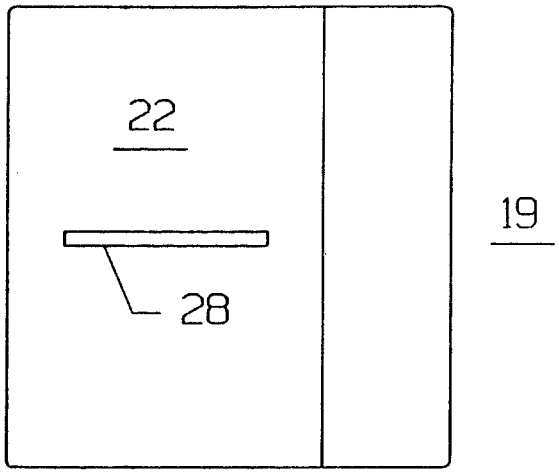
FIGS. 6*a, b* and *c* are top, side and back views, respectively, of a larger clamp according to my invention.
Figure 6B:
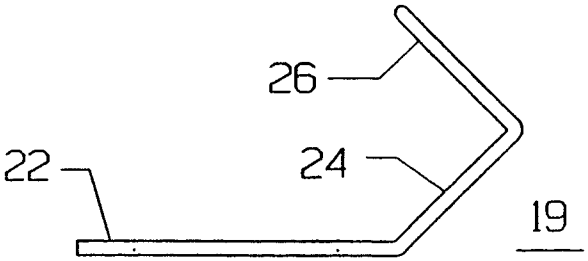
Figure 6C:
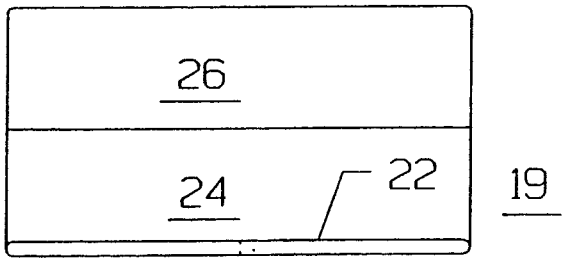
Figure 7A:
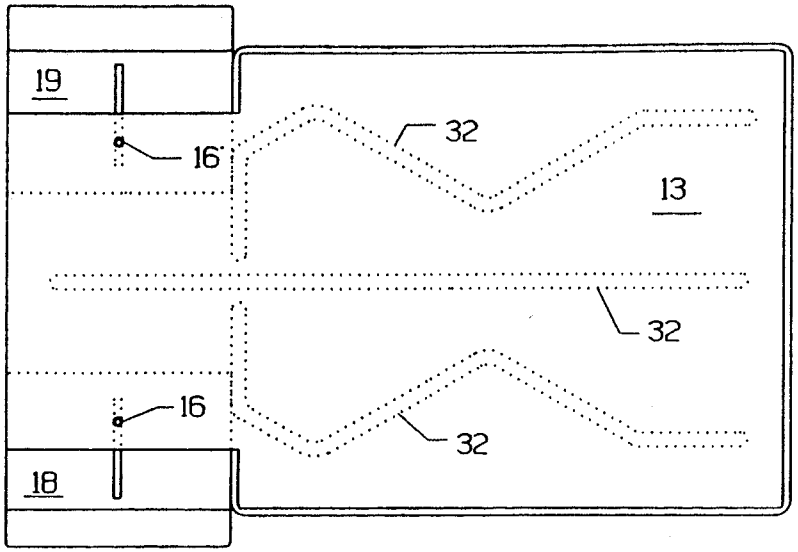
FIGS. 7*a, b* and *c* are top, front and right side views, respectively, of one embodiment of my accouterment tray with clamps.
Figure 7B:
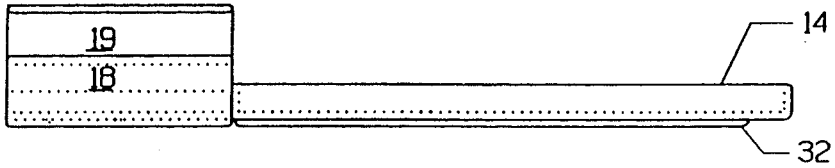
Figure 7C:
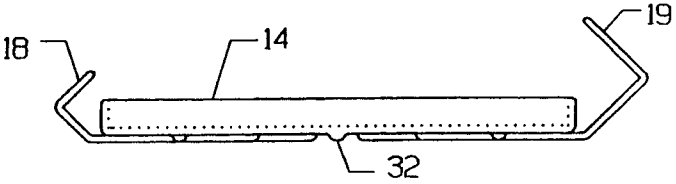

The support member 15 is securely but removably attached to the keyboard at a location below the bottom side of the keyboard by a clamp, which, in the preferred embodiment, comprises two brackets, or J-shaped clamps, 18 19, and two fasteners. This way, the support member 15 is attached in a plane parallel to the bottom side of the keyboard. As shown in FIGS. 5 through 7, each bracket 18 and 19 has planar connecting surface 21 and 22, respectively, approximately 2.75 inches long, an extending surface 23 and 24, respectively, that forms an obtuse angle of approximately 135 degrees with the connecting surfaces 21 and 22, and a clamping surface 25 and 26, respectively, that forms about a 90 degree angle with the extending surfaces 23 and 24 and points in the direction of the connecting surface 21 and 22.

In the preferred embodiment, one bracket is a smaller bracket 18, with the extending surface 23 and the clamping surface 25 each approximately 0.75 inch long, measured on the inside, and the other bracket is a larger bracket 19 with the extending surface 24 and the clamping surface 26 each approximately 1.375 inch long, measured on the inside. The smaller bracket 18, grasps the front edge of the keyboard and the larger bracket 19 grasps the thicker, back edge of the keyboard. Each bracket 18 and 19 has an open channel 27 and 28, respectively, approximately 1.75 inch long cut lengthwise through the connecting surfaces 21 and 22, respectively for receiving fasteners 20 and 20' therethrough.

Both larger bracket 19 and smaller bracket 18 are approximately 4 inches wide, matching the 4 inch length of the support member 15. However, the width of the brackets 18 and 19, and the length of the support member 15 are not crucial dimensions. Rather, the angles and lengths of the brackets 18 and 19, the length of the channels 27 and 28, and the width of the support member 15 are crucial dimensions for the preferred embodiment because they determine how well the clamping system reaches around and over the two edges of the ordinary keyboard. These crucial measurements create a preferred embodiment that is compatible with virtually every IBM and IBM-compatible keyboard.

Fasteners 20 and 20' are used to removably and adjustingly attach the brackets 18 and 19 to the support member 15. In the preferred embodiment, the fasteners 20 and 20' each comprise a screw 30 and 30' with a diameter less than the width of the channels 27 and 28, which screws extend through the holes 16 and 16' and through the channels 27 and 28, and a nut 31 and 31' that fastens to the screw 30 and 30'. When the fasteners 20 and 20' are in place but not tightened, the brackets 18 and 19 can be slid toward and away from the support member 15, by a distance and path defined by the length of the channels 27 and 28, in order to adjust the width of the "jaws" formed by the brackets 18 and 19. The brackets 18 and 19 can be locked in place by tightening down the screws 30 and 30' into the nuts 31 and 31' to tighten the fasteners 20 and 20'.

The preferred embodiment may be made of a plastic material, such as a type of thermal-formable ABS plastic or styrene, and has reinforcing ribs 32 on the bottom surface of the tray-wing 12 and support member 15. These ribs 32 add strength and rigidity to the device and also serve as guides for the sliding brackets 18 and 19.

Figure 2A:
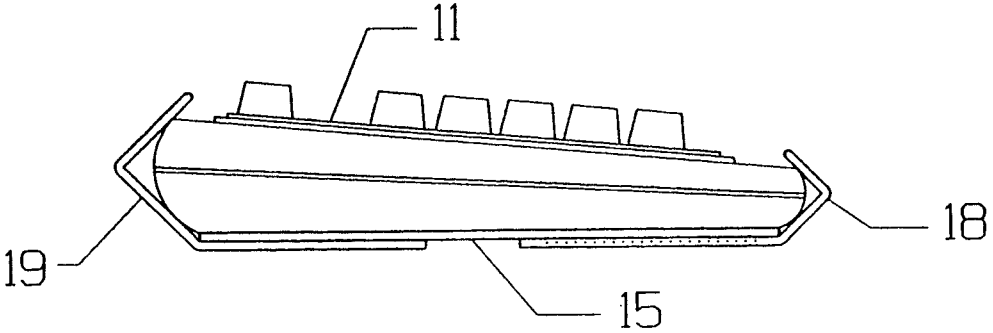
FIG. 2*a* is a left-side view.
Figure 2B:
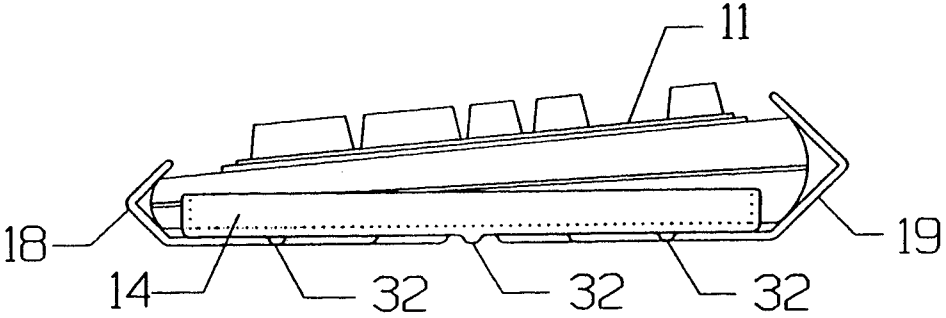
FIG. 2*b* is a right side view, from the perspective of a person using the keyboard and tray, of the embodiment depicted in FIG. 1.
Figure 3:
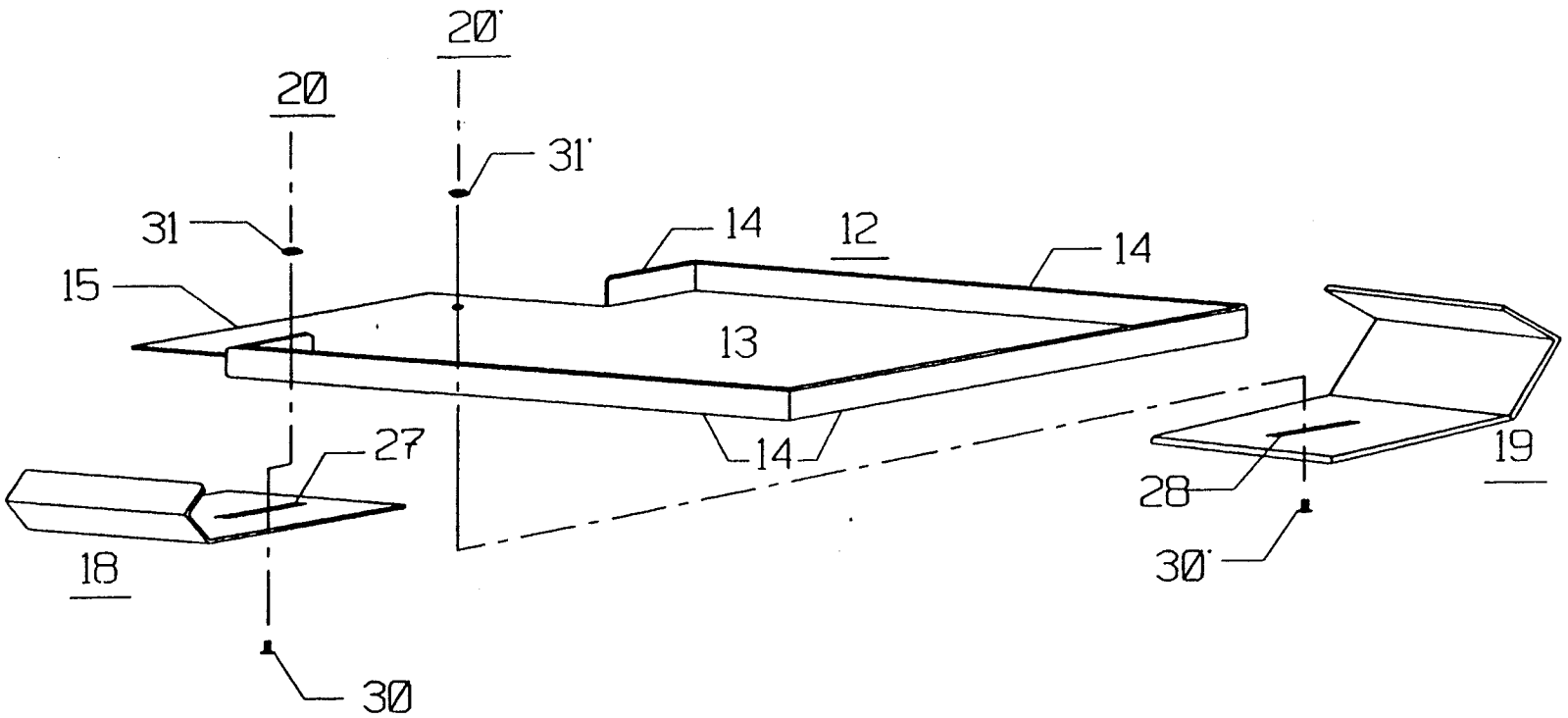
FIG. 3 is an exploded isometric view of one embodiment of my accouterment tray with clamps.

The accouterment tray is attached to a keyboard by the following method: The fasteners 20 and 20' are loosened, the brackets 18 and 19 are slid out to a distance larger than the width of the keyboard, the keyboard is placed on the support member 15, the brackets 18 and 19 are slid back toward each other until they overlap and abut the keyboard edges, and then the fasteners 20 and 20' are tightened to lock the brackets 18 and 19 in place. In this manner, the brackets 18 and 19 act like "jaws" that lock in place to grasp the keyboard with a snug and aligned fit. FIGS. 1 and 2 show the accouterment tray attached to a keyboard.

While there is shown and described the present preferred embodiment of the invention, it is to be distinctly understood that this invention is not limited thereto but may be variously embodied to practice within the scope of the following claims.

I claim:

1. A keyboard accouterment tray for attachment to a computer keyboard, said keyboard having a top surface supporting the keyboard keys, side edges and a bottom side opposite the top surface, said tray comprising means providing a keyboard and accounterment tray combination as a rigid and portable unit, said means including:

a support member, for placement below the bottom side of a keyboard, said support member being in a plane parallel to said bottom side of the keyboard;

a clamping means attached to the support member at a location below the bottom side of the keyboard, said clamping means engaging opposite side edges of the keyboard, and a tray-wing, with a firm and flat upper planar surface, rigidly extending beyond the edge of the keyboard, a removably-mounted accessory, whereby the keyboard and accouterment tray become a rigid and portable unit.

2. A keyboard accouterment tray as set forth in claim 1, in which the clamp includes two brackets, each comprising:

a planar connecting surface, parallel to the bottom plane of the keyboard, having an open channel running along its length near its midline;

an extending surface at one end of the bracket, disposed at an obtuse angle from said connecting surface, for reaching up along the side of the keyboard edge;

a clamping surface, attached to said extending surface and disposed at about a right angle from the extending surface in the direction toward said connecting surface, for reaching over the top of the keyboard edge;

a fastener connected to the support member and received by the connecting surface channel to adjustably and removably attach the bracket to the support member, whereby the brackets grasp opposing edges of the keyboard to attach the accouterment tray to the keyboard.

3. A keyboard accouterment tray as set forth in claim 2, in which one bracket has larger extending surface and clamping surfaces to grasp a thick edge of a keyboard, and the other bracket has relatively smaller extending surface and clamping surfaces to grasp the thin front edge of a keyboard.

4. A keyboard accouterment tray as set forth in claim 1, in which the tray has reinforcing ribs beside where the brackets adjustably contact the support member to guide the brackets during adjustment.

5. A keyboard accouterment tray as set forth in claim 1, in which the tray has reinforcing ribs in the tray-wing to add strength and rigidity to the tray.

6. A keyboard accouterment tray as set forth in claim 2, in which the tray has reinforcing ribs beside where the brackets adjustably contact the support member to guide the brackets during adjustment.

7. A keyboard accouterment tray as set forth in claim 2, in which the tray has reinforcing ribs in the tray-wing to add strength and rigidity to the tray.

8. A keyboard accouterment tray as set forth in claim 1, in which the tray-wing has a wall attached at its perimeter and extending up approximately perpendicularly to the upper planar surface.

9. A keyboard accouterment tray as set forth in claim 2, in which the tray-wing has a wall attached at its perimeter and extending up approximately perpendicularly to the upper planar surface.

10. A keyboard accouterment tray as set forth in claim 1, in which the upper planar surface of the tray-wing is a rectangular shape about 8.125 inches wide by 9.625 inches long.

11. A keyboard accouterment tray as set forth in claim 2, in which the upper planar surface of the tray-wing is a rectangular shape about 8.125 inches wide by 9.625 inches long.

* * * * *